United States Patent [19]

Petermann

[11] 4,087,493

[45] May 2, 1978

[54] APPARATUS FOR PROVIDING A UNIFORM COMBUSTIBLE AIR-FUEL MIXTURE

[75] Inventor: Walter E. Petermann, Caracas, Venezuela

[73] Assignee: Carbo-Economy, S.A., Caracas, Venezuela

[21] Appl. No.: 815,541

[22] Filed: Jul. 14, 1977

Related U.S. Application Data

[63] Continuation of Ser. No. 589,898, Jun. 24, 1975, abandoned.

[30] Foreign Application Priority Data

| | | |
|---|---|---|
| Feb. 13, 1975 | Switzerland | 001740/75 |
| May 22, 1975 | Venezuela | 751333/75 |

[51] Int. Cl.[2] ..... F02M 9/12

[52] U.S. Cl. ..... 261/44 D; 261/62; 261/DIG. 56; 261/DIG. 78

[58] Field of Search ..... 261/62, 44 D, DIG. 78, 261/DIG. 56

[56] References Cited

U.S. PATENT DOCUMENTS

| | | | |
|---|---|---|---|
| 976,237 | 11/1910 | Westmacott | 261/62 |
| 1,148,247 | 7/1915 | Moore | 261/44 D |
| 1,277,963 | 9/1918 | Lovejoy | 261/50 R |
| 1,358,876 | 11/1920 | Richardson | 261/62 |
| 1,378,055 | 5/1921 | Pusey | 261/41 B |
| 1,441,992 | 1/1923 | Meden | 261/62 |
| 1,495,247 | 5/1924 | Chandler | 261/62 |
| 1,620,645 | 3/1927 | Good | 261/133 |
| 1,626,085 | 4/1927 | Henriot | 261/40 |
| 1,813,866 | 7/1931 | Royce | 261/44 D |
| 1,932,764 | 10/1933 | Benjamin et al. | 261/62 |
| 2,009,233 | 7/1935 | Jennings | 261/62 |
| 2,084,489 | 6/1937 | Hess | 261/DIG. 56 |
| 2,650,081 | 8/1953 | Rockwell | 261/16 |
| 3,224,746 | 12/1965 | Boyle et al. | 261/50 A |
| 3,282,572 | 11/1966 | Karlovitz | 261/DIG. 78 |
| 3,336,014 | 8/1967 | Shorrock | 261/44 F |
| 3,778,038 | 12/1973 | Eversole et al. | 261/DIG. 78 |
| 3,953,548 | 4/1976 | Knapp | 261/DIG. 56 |
| 4,023,942 | 5/1977 | Brady et al. | 261/62 |

*Primary Examiner*—Tim R. Miles
*Attorney, Agent, or Firm*—Brumbaugh, Graves, Donohue & Raymond

[57] ABSTRACT

A carburetor for gasoline internal combustion engines includes a generally cylindrical housing having a mixing channel defined by a wall converging to a point of minimum housing diameter and a wall diverging from the point of minimum diameter, an intake air receiving section and a lower section from which the liquid fuel-air mixture is discharged to the cylinders. At least twelve radially spaced liquid fuel supply ports are formed in the mixing chamber immediately below the point of minimum opening. A regulating member formed generally of two frusto-conical sections arranged with their bases end-to-end is mounted for longitudinal movement within the housing. The upper section of the regulating member deflects the intake air toward a gradually enlarging constricted zone which is defined by the upper section of the regulating member and the diverging wall of the mixing chamber and wherein the liquid fuel is mixed with and atomized by the intake air. The lower section of the regulating member and the lower section of the housing define a turbulence zone.

11 Claims, 5 Drawing Figures

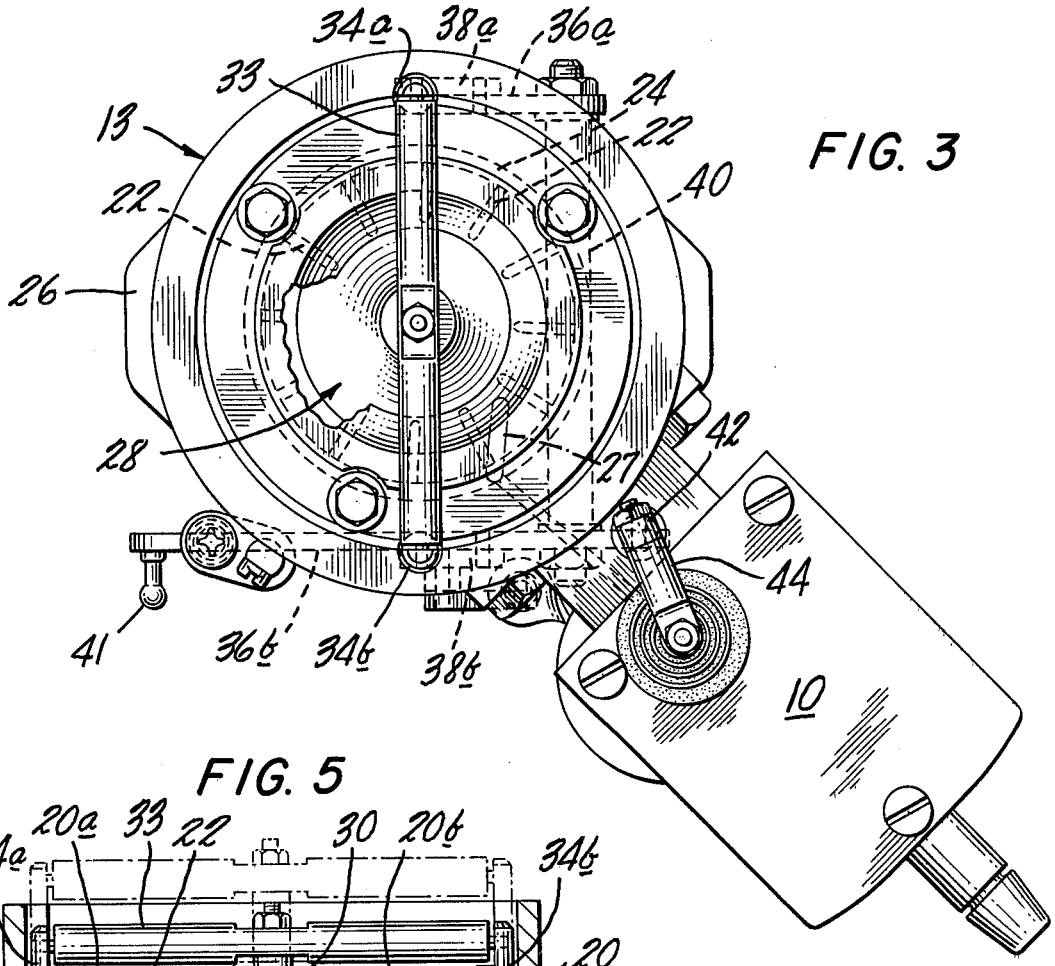
FIG. 3
FIG. 5
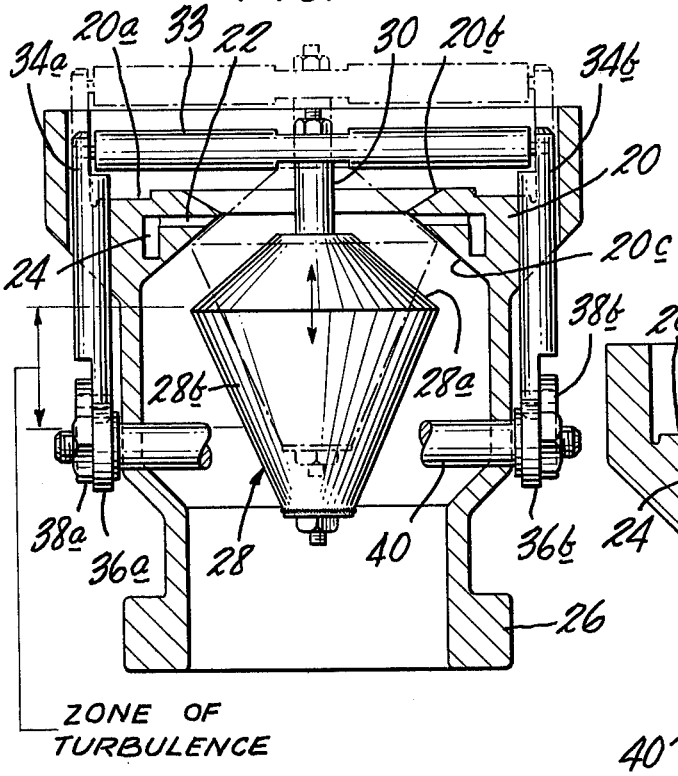
FIG. 4
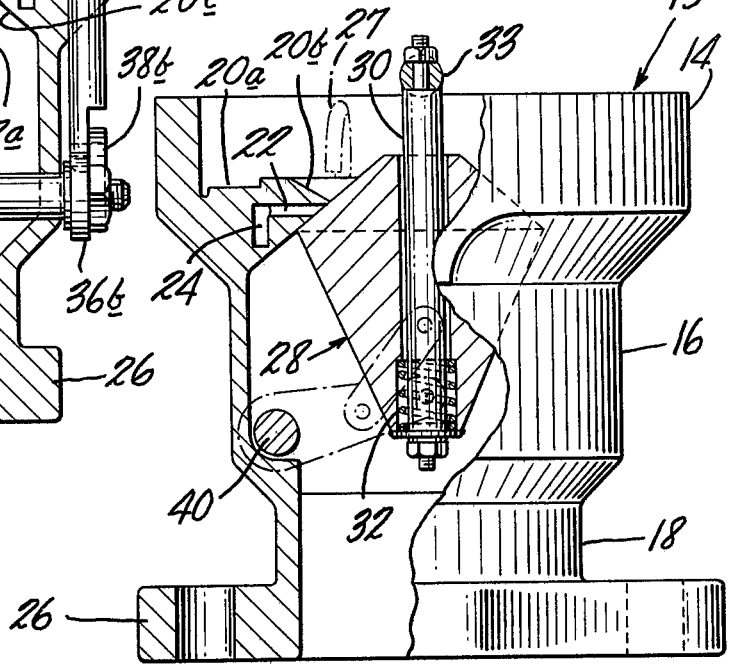

APPARATUS FOR PROVIDING A UNIFORM COMBUSTIBLE AIR-FUEL MIXTURE

This is a continuation of application Ser. No. 589,897 filed June 24, 1975 now abandoned.

BACKGROUND OF THE INVENTION

The present invention relates to air-liquid fuel mixing devices, and, more particularly, to a device which mixes liquid fuel and air and provides a uniform combustible air-fuel mixture under all operating conditions to one or more burning areas, such as the cylinders of a gasoline internal combustion engine, where complete combustion of the air-fuel mixture occurs.

The present invention finds particular utility as a carburetor for gasoline internal combustion engines and, accordingly, this statement of background will be given in the context of the carburetor art. The design and operation of improved carburetors for gasoline internal combustion engines has been the subject of extensive research and development work, especially since the dramatic increase in the price of oil (with further increases expected) and the enactment of federal and state regulations concerning the emission by automobiles of pollutants into the atmosphere. For example, 40 C.F.R. 85.076-1 (July 1, 1974) has prescribed that exhaust emissions from 1976 model automobiles may not exceed 0.41 grams of hydrocarbon per vehicle mile, 3.4 grams of carbon monoxide per vehicle mile and 0.40 grams of oxides of nitrogen per vehicle mile. Later amendments to the code imposed less stringent standards.

Ongoing research and development has been aimed at improving the mixing between the liquid fuel and the intake air drawn through the carburetor and developing a uniform mix of air and liquid fuel over the full range of operating conditions of the engine. Several of such carburetor designs are illustrated and described in the Eversole et al U.S. Pat. No. 3,778,038. The carburetors of the Eversole et al patent include an elongated upper section that tapers down to a point of minimum diameter and a lower section that diverges outwardly from the point of minimum diameter. A longitudinally adjustable regulating member is mounted within the carburetor and forms with the upper section a so-called constricted zone. Fuel outlets spray fuel into the air stream at or just forward of the point of minimum diameter. The divergence angle of the lower section is kept quite small, viz., the cross-sectional area in the lower section increases with distance as would a cone having an apex angle of 6° to 18°. According to the patent, this permits the formation of two zones in the lower section, a supersonic zone where the velocity of the fuel-air mixture is increased to supersonic and a subsonic zone where the velocity of the air-gas mixture is decelerated to subsonic.

A principal disadvantage with the type carburetors shown in the Eversole et al patent is that the air speed through the carburetor must be carefully controlled in order to insure the development of sonic and supersonic velocities for the air-fuel mixture. The development of such velocities is critical to the development of combustible fuel-air mixtures. Thus, abrupt changes in engine acceleration can result in stalling because of reduced air speed or incomplete combustion with the attendant emission of pollutants into the atmosphere. In addition, this type carburetor is susceptible to icing, condensation and high manifold vacuum producing low volumetric efficiency and therefore reduced engine power.

SUMMARY OF THE INVENTION

It is therefore an object of the present invention to provide a new and improved liquid fuel and air mixing device which provides a uniform combustible air-fuel mixture under all operating conditions to one or more burning areas.

It is further object of the present invention to provide a new and improved carburetor for gasoline internal combustion engines which provides a uniform fuel-air mixture having a constant air-to-fuel ratio over the full range of operating conditions of the engine.

It is another object of the present invention to provide a new and improved carburetor for gasoline internal combustion engines which reduces consumption of gasoline by the engine as compared to conventional carburetors and, at the same time, reduces significantly the emission of pollutants over a full range of operating conditions of the engine.

These and other objects are accomplished by the present invention which comprises a housing having formed therein a mixing chamber defined by a wall converging to a point of minimum housing aperture and a wall diverging from the point of minimum diameter, an upper intake air receiving section and a lower section from which the liquid fuel-air mixture is discharged to a burning area. A plurality of radially spaced liquid fuel supply ports are formed in the mixing chamber immediately below the point of minimum aperture.

A regulating member is mounted for longitudinal movement within the housing and, together with the diverging wall of the mixing chamber, forms a gradually enlarging constricted zone wherein the liquid fuel is mixed with and atomized by the air to provide a uniform combustible mixture with a constant air-to-liquid fuel ratio. The regulating member and the lower section of the housing also define a turbulence zone through which the air-fuel mixture discharged from the constricted zone flows in a turbulent manner between the regulating member and the lower section.

Preferably, the regulating member is formed of two frusto-conical sections arranged with their bases end-to-end. The bases of the two sections have the same diameter, and such diameter is larger than the minimum diameter of the mixing chamber. In order to provide the constricted zone of gradually increasing area, the taper angles of the diverging wall of the mixing chamber and the upper conical section of the regulating member are the same. At its maximum upward travel within the mixing chamber, the upper section of the regulating member engages the diverging wall of the mixing chamber to seal off the gas supply ports. During operation of the engine, the regulating member reciprocates within the mixing chamber in accordance with operators control of the gas pedal. The upper conical section deflects the intake air stream toward the constricted zone. During acceleration, the regulating member is driven downwardly to increase the size of the constriction zone and permit greater volumes of air-fuel mixtures to be supplied to the cylinders of the engine. From idle to full throttle, there remains a constant relationship between the inlet opening of the constricted zone and the outlet opening of the constricted zone. Preferably, the outlet opening has twice the area of the inlet opening. Retaining the constant relationship is crucial to the achievement of a uniform air-fuel mixture under all operating conditions of the engine. Once past the constricted zone, the air-fuel mixture flows in a turbulent manner through the lower section.

It will be observed that the constricted zone has the attributes of a widely divergent, short, annular nozzle defined by a fixed wall and a longitudinally movable wall. The divergence of the nozzle produces a three-dimensional, non-insentropic, and inefficient flow of the air-fuel mixture. With a nozzle of this configuration, high velocities are not required to produce atomization. A friction is created within the nozzle that advances the atomization of the liquid fuel. Moreover, the short length of the nozzle necessarily minimizes the heat transfer between the walls of the nozzle and the air-fuel mixture.

BRIEF DESCRIPTION OF THE DRAWINGS

In the Drawings:

FIG. 3 is a plan view of the carburetor shown in FIG. 1;

FIG. 4 is a sectional view, partly broken away, of the FIG. 1 carburetor which shows the relationship between the parts when the engine is stopped; and FIG. 5 is a sectional view, partly broken away, of the FIG. 1 carburetor which shows the relationship between the parts when the engine is running at full speed.

DESCRIPTION OF THE PREFERRED EMBODIMENT

Figure 1:
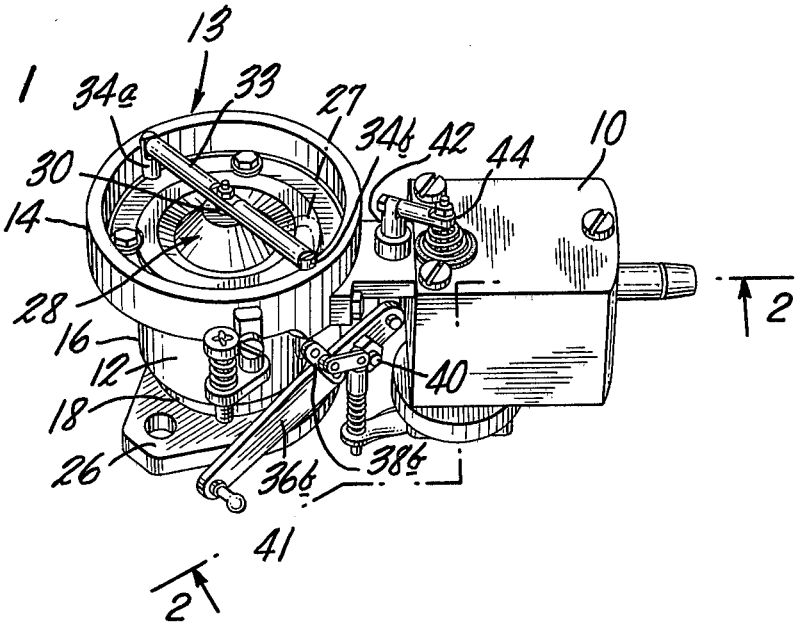
FIG. 1 is a perspective view of a carburetor for use with a gasoline internal combustion engine arranged according to the present invention.

In the preferred embodiment of the invention, as shown in FIGS. 1–5, the invention is adapted for use as a carburetor in a gasoline internal combustion engine. The carburetor consists generally of two principal units, a float-controlled fuel reservoir 10 whose structure and operation are conventional, and an air-liquid fuel mixing unit 12 whose structure and operation constitute the applicant's invention.

The unit 12 comprises an open cylindrical housing 13 which includes three sections; an upper section 14, a middle section 16 of slightly smaller diameter than the upper section 14 and a lower section 18 of slightly smaller diameter than the middle section 16. The upper section 14 has a generally ring-like configuration and forms the air inlet section of the unit 12. As conventionally practiced, the upper section 14 is connected to an air filter (not shown).

Extending from the upper section 14 through the middle section 16 in the housing is a mixing chamber wherein the mixing of the intake air and liquid fuel takes place, as will be described in detail hereinbelow. The mixing chamber is formed by an insert 20 which is of one part construction with the housing 13. The insert 20 includes an upper wall **20*a* in the upper section 14 that extends radially inwardly from the wall of the housing 13, a wall 20*b* that converges downwardly to a point of minimum aperture, and a wall 20*c* that diverges outwardly from the point of minimum aperture to the wall of the housing 13 which circumscribes the middle section of the housing 13**.

Neither the extent nor the angle of convergence of the wall **20*b* of the insert 20 is generally critical to the operation of the applicant's invention. All that is required of the wall 20*b* is that it provide some acceleration to the intake air drawn by the engine through the housing 13. The angle of divergence of the wall 20*c* is critical, however, to the successful operation of the present invention. Preferably, the wall 20*c*** diverges sharply from the point of minimum aperture at an angle in the range from about 32° to 48° and preferably at an angle of 45°.

Formed in the insert 20 immediately below the point of minimum aperture are a plurality of equally spaced radial fuel supply openings 22. The openings are supplied simultaneously with liquid fuel from a fuel supply line 24 in the form of a circular opening 24 formed in the wall of the housing 13. Preferably, at least twelve radial openings are formed at thirty degree spacings in the insert 20. It is believed that more than twelve fuel supply openings may be employed in the present invention with equally good results.

The size of each of the radial fuel supply openings has a direct relationship with the size of the air bleed (not shown) in the gas supply reservoir 10. As is well known, air bleeds permit the instantaneous supply of gas from a fuel reservoir to the carburetor without fading. in carburetors constructed in accordance with the present invention, radial openings of 1.1 mm., 0.9 mm. and 0.7 mm. have been formed in the insert 20.

The radial openings 22 are formed in the insert just below the point of minimum aperture in the mixing chamber, and not at such point, in order to take full advantage of the increased intake air speed and reduced vacuum existing at the point of minimum aperture. In this way, gas drawn through the radial openings 22 is fully entrained in the intake air and atomized thereby.

The housing 13 finally comprises a mounting flange extending from the lower section 18 of the housing 13. The housing 13 is secured to the intake manifold of the engine (not shown) by placing the flange next to the manifold and then bolting the flange to the manifold. As an optional feature and as shown in the Figures, an additional fuel jet 27 may be mounted in the inlet section 14. Such as fuel jet will generally be included when the carburetor of the present invention is used to replace a conventional fourbarrel carburetor, but not with single or double barrel carburetors. The injector will provide the additional liquid fuel necessary to start the engine.

Figure 2:
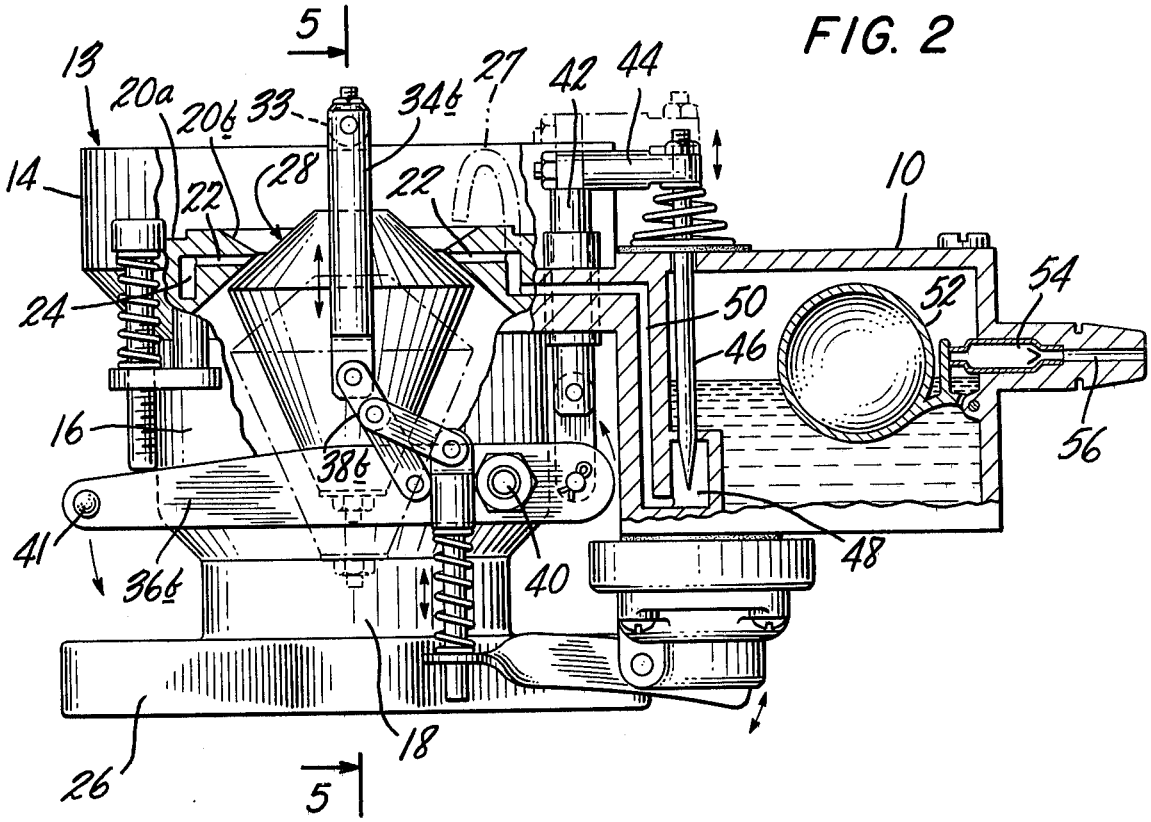
FIG. 2 is a sectional view, partly broken away, of the carburetor shown in FIG. 1 taken along line 2—2 and looking in the direction of the arrows.

As best shown in FIGS. 2, 3 and 4, a regulating member 28 is mounted for longitudinal movement within the housing 13. The member 28 is formed of two sections **28*a* and 28*b*, having generally frusto-conical configurations, with the bases of the two sections arranged end-to-end. The base diameter of the cones is greater than the diameter of the opening formed by the insert 20. The section 28*a* is much shorter in length than section 28*b* and converges from its base at an angle which is smaller than the convergence angle of the section 28*b*, but the same as the angle of divergence of the wall 20*c* of the insert 20. The angle of convergence is preferably 45° and may range from 32° to 48°. As best shown in FIGS. 2 and 5, section 28*a* of the regulating member and the diverging wall 20*c* of the insert define a constricted zone wherein the liquid fuel supplied by openings 22** is drawn into the intake air, mixed and uniformly distributed within the intake air.

The angle of convergence of the section **28*b* ranges from about 34° to 26°. The greater length of the section 28*b* provides, together with the wall of the middle section 16** of the housing, a relatively large area (turbulence zone) where the liquid fuel-air mixture discharged therein is subjected to turbulence so as to create further atomization of the liquid fuel entrained in the intake air and admixing of the intake air and the liquid fuel.

The location of the regulating member 28 within the housing 13 and the configurations of the insert 20 and the regulating member 28 are such that the upper section 28*a* extends into the air inlet section 14 but bears against the diverging wall 20*c* of the insert to seal off the radial fuel ports 22 and preclude air from flowing through the mixing chamber when the engine is inoperative (FIG. 4). With the engine operative, the upper section 28*a* of the regulating member and the diverging wall 20*c* of the insert form a constricted zone into which the intake air sweeping through the zone draws the fuel from the openings 22. The inlet opening of the constricted zone is located at the radial fuel ports 22, while the outlet opening is located at the junction between the two cones 28*a* and 28*b* forming the regulating member. As it is drawn into the constricted zone, the liquid fuel is atomized (broken into small droplets) by the air and becomes entrained therein. The result is the formation in the constricted zone of a generally uniform mixture of air and liquid fuel.

It will be noted that the insert 20 and regulating member 28 define a constricted zone wherein a constant relationship exists between the areas of inlet and outlet openings of the constricted zone under all operating conditions of the engine. Specifically, no matter what the position of the regulating member 28 within the unit 12 (fully open as shown in FIG. 5 or idling as shown in FIG. 2) there will be an approximately constant ratio between the area at the outlet opening and the area at the inlet opening. For the angle shown, the ratio is two-to-one. In so increasing the area within the constricted zone from the inlet to the outlet thereof under all operating conditions, the volume of liquid fuel and air that is supplied to the turbulence zone and then to the intake manifold is directly related to the volume of liquid fuel and air that exists at the inlet opening of the constricted zone. There will be the same relative reduction in velocity of the liquid fuel-air mixture from the inlet of the constricted zone to the outlet of the constricted zone under all operating conditions. Operating fuel-air ratios of about nineteen to one are preferably formed at all operating conditions.

As noted above, the configurations of the regulating member 28 and the housing provide for additional mixing of the liquid fuel and air mixture in the turbulence zone after the mixture passes out of the constricted zone. The further mixing produces further atomization of the fuel and insures the uniformity of the distribution of the atomized fuel within the intake air.

The regulating member 28 is rotatably mounted on a pin 30 which extends through the center of the housing 13. A spring 32 is mounted within the lower section 28*b* of the regulating member 28 and constantly urges the regulating member 28 upwardly and into contact with the diverging wall 20*c* of the insert 20.

The pin 30 is carried by a support bar 33 which extends diametrically across the air inlet section 14 of the housing 13. The ends of the bar 32 are connected to a pair of guide shafts 34*a* and 34*b* which extend downwardly across opposite sides of the housing 13 and are coupled to a pair of driving levers 36*a* and 36*b* by linkages 38*a* and 38*b*. Linkage 38*b* is spring-biased. The levers 36*a* and 36*b* are, in turn, connected together by a shaft 40 (FIG. 3). As best shown in FIG. 3, the lever 36*b* is elongated and includes a connecting pin 41 which is connected in usual fashion to the accelerator, such as a pedal, of the gasoline internal combustion engine.

With depression of the gas pedal to provide corresponding acceleration, the pin 41 is driven downwardly. The lever 36*b*, in turn, rotates the shaft 40 with the result that the guide shafts 34*a* and 34*b* are driven downwardly. The support bar 33 is driven downwardly and the regulating member 28 is displaced from the insert 20 a distance corresponding to the vertical displacement of the pin 30 upon which the member 28 is supported. In like manner, deceleration of the accelerator causes movement of the regulating member 28 upwardly and toward engagement with the insert 20.

The end of the lever 36*b* opposite the connecting pin 41 is connected to a linkage 42 which, in turn, is coupled by way of a connecting member 44 to a spring-biased valve needle 46 located in the fuel reservoir 10. The valve needle 46 is arranged in the reservoir such that its tapered end engages a fuel outlet opening 48 formed in the reservoir 10. The valve needle 46 operates to regulate the flow of the liquid fuel out of the reservoir 10 and through the outlet opening 48 and into a fuel supply passage 50. The fuel supply passage 50 opens into circular fuel distribution passage 24 formed in the insert 20.

The fuel reservoir 10 also includes a float 52 which cooperates with a float needle 54 arranged in a main fuel supply line 56 which is directly coupled to the fuel pump of the engine. The float 52 and the needle 54 regulate the fuel level in the fuel reservoir to a constant volume.

FIG. 2 depicts the relationship between the insert 20 and the regulating member 28 of the carburetor of the present invention when the engine controlled by the carburetor is idling. As noted above, the spring 32 mounted in the regulating member 28 urges the regulating member into contact with the insert 20. Air drawn by the engine through the housing 13 overcomes the spring biasing to narrowly separate the regulating member 28 from the insert 20. With a small gap between the upper cone 28*b* of the regulating member and the diverging wall 20*c* of the insert, liquid fuel will flow from the reservoir 10 through the fuel supply line 50, annular opening 24 formed in the housing 13, and into the gas supply openings 32 formed in the insert 20. The intake air draws the fuel from the fuel supply ports 22 into the constricted zone defined by the cone 28*b* and the diverging wall 20*c* where the fuel is atomized by the intake air. The resulting liquid fuel droplets are uniformly distributed into the intake air within the constricted zone. The intake air is flowing at maximum velocity at the point of contact with the liquid fuel. The fuel is thus mixed with the air and atomized by it. From this point, the velocity of the liquid fuel and air mixture decreases gradually as the mixture passes through the constricted zone. The liquid fuel and air mixture occupies about twice the area at the outlet opening of the constricted zone than it does at the inlet opening of the constricted zone.

Once beyond the constricted zone, the air-fuel mixture flows turbulently in the zone defined by the lower section 28*b* of the regulating member and the wall of the housing 13. Thereafter, the liquid fuel and air mixture is fed to all the engine's cylinders in a uniform manner. Preferably, the air-fuel mixture is in the ratio of 19:1 but other ratios can be employed. As will be understood, the ratio will change in accordance with the type engine the present invention is used with. The ratio can also vary in accordance with the specific requirements for the engine. For example, the design of the present invention as shown in the drawings provides excellent gasoline economy and excellent suppression of the emission of pollutants. The design, however, can be modified to provide maximum gas mileage with relatively low emission of pollutants, at one extreme, to maximum suppression of pollutants combined with reasonable mileage efficiency. The difference in design can be achieved by changing the angle of convergence of the upper cone 28*a* of the regulating member 28.

Upon actuation of the accelerator to increase engine speed, lever 36*b* is pulled downwardly to rotate the connecting arm 40 and drive the regulating member away from the insert 20. At the same time, the pivoting of the lever 36*b* raises the regulating needle 46 in the fuel reservoir 10 to permit greater amounts of liquid fuel to pass from the reservoir to the fuel supply openings 22 formed in the insert 20. In this condition, the air drawn by the engine through the housing 13 will continue to overcome the biasing of spring 32.

As shown in FIG. 5, the insert 20 and the regulating member 28 define a relatively large constricted zone to permit the mixture of greater amounts of liquid fuel and air. The area, however, at the outlet end of the constricted zone bears the same relationship to the area at the inlet opening of the constricted zone, i.e., 2:1. Thus, the same uniform liquid fuel-to-air mixture is created within the constricted zone for this "open" throttle condition as was created for the idling condition and as will be created for any operating condition of the engine. Again, the liquid fuel and air mixture is remixed in the turbulence zone after passage through the constricted zone and a completely uniform liquid fuel and air mixture is supplied to the cylinders of the engine.

In view of the foregoing, it will be seen that the carburetor of the present invention provides generally a uniform combustible liquid fuel and air mixture over all ranges of engine speeds and under any operating conditions. The advantages attendant the use of the carburetor of the present invention with a gasoline internal combustion engine include reduced fuel consumption and the suppression of pollutant emission. The engine speed can be reduced to fewer than 400 rpm, lower octane gasolines may be used and the engine will run smoothly under all operating conditions.

The present invention further permits a carburetor design of reduced vertical dimension because the mixing chamber and regulating member configurations produce a thorough atomization of the liquid fuel and the uniform distribution of the atomized liquid fuel into the intake air within a relatively small area. In addition, the carburetor of the present invention may be enlarged to replace multiple barrel carburetors of conventional design.

I claim:

1. A carburetor for supplying metered amounts of atomized liquid fuel to an internal combustion engine comprising (1) an open generally cylindrical housing having an upper intake air receiving section with a generally ring-like configuration a mixing chamber into which intake air from the upper section passes directly, said mixing chamber defined by a radial wall that extends inwardly from the wall of the housing and forms an opening smaller in diameter than the opening of the upper intake air receiving section, a wall that converges downwardly from the radial wall to a sharp edge forming the smallest opening within the carburetor housing, and a wall that diverges from the sharp edge to the wall of the housing, said mixing chamber also including liquid fuel supply means for supplying liquid fuel into the intake air immediately below the sharp edge of the mixing chamber, a lower turbulence section for passing without obstruction liquid fuel and air directly to the manifold of the internal combustion engine; (2) a regulating member in the configuration of upper and lower cone-like sections arranged with a common base and mounted for reciprocating movement within at least the mixing chamber and the turbulence section, the upper cone-like section of the regulating member functioning to deflect the intake air toward a gradually enlarging constricted zone defined by the upper cone-like section and the diverging wall of the mixing chamber and wherein the liquid fuel is mixed with and atomized by the intake air and the lower cone-like section of the regulating member defining within the turbulence section a turbulence zone wherein the air and liquid fuel exiting from the constricted zone are subjected to turbulence to provide further mixing of the atomized fuel with the intake air; and (3) control means coupled to the regulating member for selectively reciprocating the regulating member in accordance with engine speed substantially axially within the housing to thereby vary the area of the constricted zone and the amount of intake air and liquid fuel mixed therein.

2. Apparatus according to claim 1 wherein the taper angle for the upper section of the regulating member and the diverging wall of the mixing chamber is the same and ranges from about 32° to about 48°.

3. Apparatus according to claim 1 wherein the taper angle is 45°.

4. Apparatus according to claim 2 wherein the lower section of the regulating member tapers downwardly from the base thereof at an angle ranging from about 34° to about 26°.

5. Apparatus according to claim 4 wherein the taper angle of the lower section of the regulating member is 30°.

6. Apparatus according to claim 1 wherein the liquid fuel supply means comprises a plurality of equally spaced radial fuel supply ports formed in the divergent wall of the mixing chamber immediately below the sharp edge thereof.

7. Apparatus according to claim 6 wherein at least twelve equally spaced radial fuel supply ports are formed in the divergent wall of the mixing chamber.

8. Apparatus according to claim 1 wherein the regulating member is in the configuration of upper and lower frusto-conical sections with a common base having a diameter greater than the diameter of the opening formed by the sharp edge of the mixing chamber and wherein the regulating member is mounted for reciprocating movement between a position whereat the upper section of the regulating member extends beyond the sharp edge of the mixing chamber and engages the diverging wall of the mixing chamber to seal off the liquid fuel supply means and a position whereat the upper section of the regulating member is located below the sharp edge of the mixing chamber and defines with the diverging wall of the mixing chamber a large constricted zone wherein the liquid fuel is mixed with and atomized by the intake air.

9. Apparatus according to claim 8 wherein the regulating member has formed through its length a central bore, and wherein the control means comprises mounting means for supporting and reciprocating the regulating member in the housing, said means comprising a support bar extending diametrically across the intake air receiving section of the housing, pin member disposed centrally within the housing and extending through the central bore of the regulating member and coupled to the support bar, and linkage means coupled to both ends of the support bar and adapted to reciprocate the support bar in response to mechanical pressure being applied thereto.

10. Apparatus according to claim 9 further comprising a liquid fuel reservoir, means for coupling the reservoir to the liquid fuel supply means, and means coupled to the linkage means for controlling the amount of liquid fuel supplied to the fuel supply means in accordance with the position of the regulating member within the housing.

11. Apparatus according to claim 9 wherein the regulating member is freely rotatable about the pin member and includes a spring means mounted internally thereof and around the pin member for urging the regulating member upwardly along the pin member and into engagement with the diverging wall of the mixing chamber.

* * * * *